US005860264A

United States Patent [19]

Gephart et al.

[11] Patent Number: 5,860,264

[45] Date of Patent: Jan. 19, 1999

[54] GASKETLESS ALUMINUM FRAME FOR WARDROBE DOORS

[75] Inventors: John D. Gephart, Rocky Hill; Paul R. Cusson, West Hartford, both of Conn.

[73] Assignee: The Stanley Works, New Britain, Conn.

[21] Appl. No.: 709,267

[22] Filed: Sep. 6, 1996

[51] Int. Cl.[6] ..... E04C 2/38

[52] U.S. Cl. ..... 52/656.4; 52/482; 52/734.1; 52/785.1; 52/204.71; 52/800.14

[58] Field of Search ..... 52/482, 734.1, 52/785.1, 656.4, 656.5, 800.12–800.14, 204.71, 204.53

[56] References Cited

U.S. PATENT DOCUMENTS

| | | | |
|---|---|---|---|
| 2,205,519 | 6/1940 | Eiber et al. . | |
| 2,576,348 | 11/1951 | Kinghorn . | |
| 2,798,261 | 7/1957 | Greig | 52/800.13 |
| 2,798,262 | 7/1957 | Beamer | 52/800.13 |
| 3,112,534 | 12/1963 | Winnan . | |
| 3,214,879 | 11/1965 | Ellingson, Jr. et al. . | |
| 3,426,482 | 2/1969 | Mock | 52/800.13 X |
| 3,784,043 | 1/1974 | Presnick | 52/800.12 X |
| 3,824,753 | 7/1974 | Anderson . | |
| 3,866,373 | 2/1975 | Hudock | 52/781 X |
| 3,879,912 | 4/1975 | Cox | 52/734.1 |
| 4,335,552 | 6/1982 | Blanchett et al. . | |
| 4,407,099 | 10/1983 | McLaughlin . | |
| 4,631,894 | 12/1986 | Jerila | 52/800.13 |
| 4,747,248 | 5/1988 | Fahs | 52/656.9 X |
| 5,237,785 | 8/1993 | Lukes | 52/202 X |
| 5,473,853 | 12/1995 | Guillemet et al. | 52/202 X |

*Primary Examiner*—Carl D. Friedman
*Assistant Examiner*—Yvonne Horton-Richardson
*Attorney, Agent, or Firm*—Pepe & Hazard

[57] ABSTRACT

A panel door has a generally rectangular panel which is seated in a frame provided by opposed pairs of integrally formed gasketless door stile and rail elements. Each frame element has an outer wall, a front wall, and a rear wall. The juncture of the rear wall and the outer wall of the aluminum extrusions is configured to enable resilient deflection of the rear wall relative to the outer wall, and the front and rear walls form a channel therebetween to receive the edge portion of the panel. Corner connectors couple the ends of the stiles and rails. The resiliently deflectable rear walls bear upon the rear surface of the panel and press it against the front wall to securely seat it in the channels.

20 Claims, 5 Drawing Sheets

GASKETLESS ALUMINUM FRAME FOR WARDROBE DOORS

BACKGROUND OF THE INVENTION

The present invention relates to mirror doors, and, more particularly, to a gasketless frame for receiving the edges of mirrors and other planar panels.

Mirrors or doors with mirrors on a face thereof are widely employed in bedrooms, bathrooms, wardrobes and dressing rooms to enable viewing of attire on the wearer, to enhance the appearance of rooms, or to provide special effects. In some instances, the mirror itself comprises a sliding panel, but preferably its periphery is seated in a peripheral frame to provide a sliding shower or wardrobe door.

Flexible vinyl gaskets are commonly employed between a channel in the frame and the glass panel to help seat the panel tightly within the frame and to provide a water seal in shower doors. Generally, the appearance of the frame can vary greatly in size, shape and color. Because the flexible gaskets are usually visible in part, it is desirable for them to match the frame in contour and color for aesthetic reasons. However, a vinyl gasket will rarely completely match an extruded aluminum frame, and it is difficult to clean, detracts from the appearance, and is costly and time consuming to install. Alternatives to vinyl gaskets include adhesives and sealants applied as tapes and liquids, but these also are at best time consuming and relatively messy to apply.

Accordingly, it is an object of the present invention to provide a novel gasketless frame for a panel door to retain the panel securely therein.

It is also an object to provide such a frame which enables simple and rapid assembly of the door.

Still another object is to provide novel framing elements for such a frame which may be readily and economically fabricated and which produce a long lasting rugged assembly.

SUMMARY OF THE INVENTION

It has now been found that the foregoing and related objects may be readily attained in a panel door comprising a generally rectangular panel, and a frame including a pair of horizontally spaced, integrally formed gasketless door stile elements and a pair of vertically spaced, integrally formed gasketless door rail elements for receiving the side edges of the panel. The frame elements have front, rear, outer and inner faces, and an outer wall provides the outer face and has front and rear sides. A rear wall extends inwardly along the rear side of the outer wall and provides the rear face, and the junction of the rear wall and the outer wall is configured to enable resilient deflection of the rear wall relative to the outer wall. A relatively rigid front wall provides the front face and extends inwardly along the front side of the outer wall.

The stile has an inner wall which extends from the inner end of the rear wall towards the front wall and terminates at a point spaced therefrom to provide a channel to receive the edge portion of the panel. The stile inner wall has a flange extending inwardly from its free edge, and the junction between the flange and inner wall resiliently bears upon the panel seated in the channel.

The front wall of the rail has a free end portion which extends towards the rear of the rail and a depending flange on its end. The rail rear wall has a first portion angled towards the front wall and a second portion adjacent its free end angled oppositely. The depending flange on the front wall and the second portion of the rear wall form a channel to receive the edge portion of the panel, and the junction of the first and second portions of the rear wall resiliently bears upon the panel seated in the channel. Corner connectors couple the ends of the stiles and rails.

The stiles and rails are initially formed as extrusions which are then further formed to provide the desired channel width.

Generally, the junction of the rear wall and the outer wall of the rails and stiles includes a groove which extends along their inner surface to facilitate the resilient deflection. Usually, the panel is a mirror.

Preferably, the front wall of the stiles has at least one projection on its surface opposite the inner wall which bears upon the panel seated in the channel. Desirably, the flange of the stiles has barbs on the surface thereof to grip the surface of the panel seated in the channel.

The front wall of the stiles has a flange extending from its inner surface towards the rear wall and spaced intermediate the inner and outer walls to seat the end of the panel. Preferably, the free end of the front wall of the stiles includes a flange extending generally perpendicularly thereto in the frontal direction.

The outer wall of the rails has an inwardly extending rib on its inner surface, and the front edge of the rib is generally aligned with the juncture of the portions of the rear wall to seat an edge portion of the panel thereagainst and prevent rotation of the rail about the edge of the panel.

DETAILED DESCRIPTION OF THE PREFERRED EMBODIMENT

Figure 1:
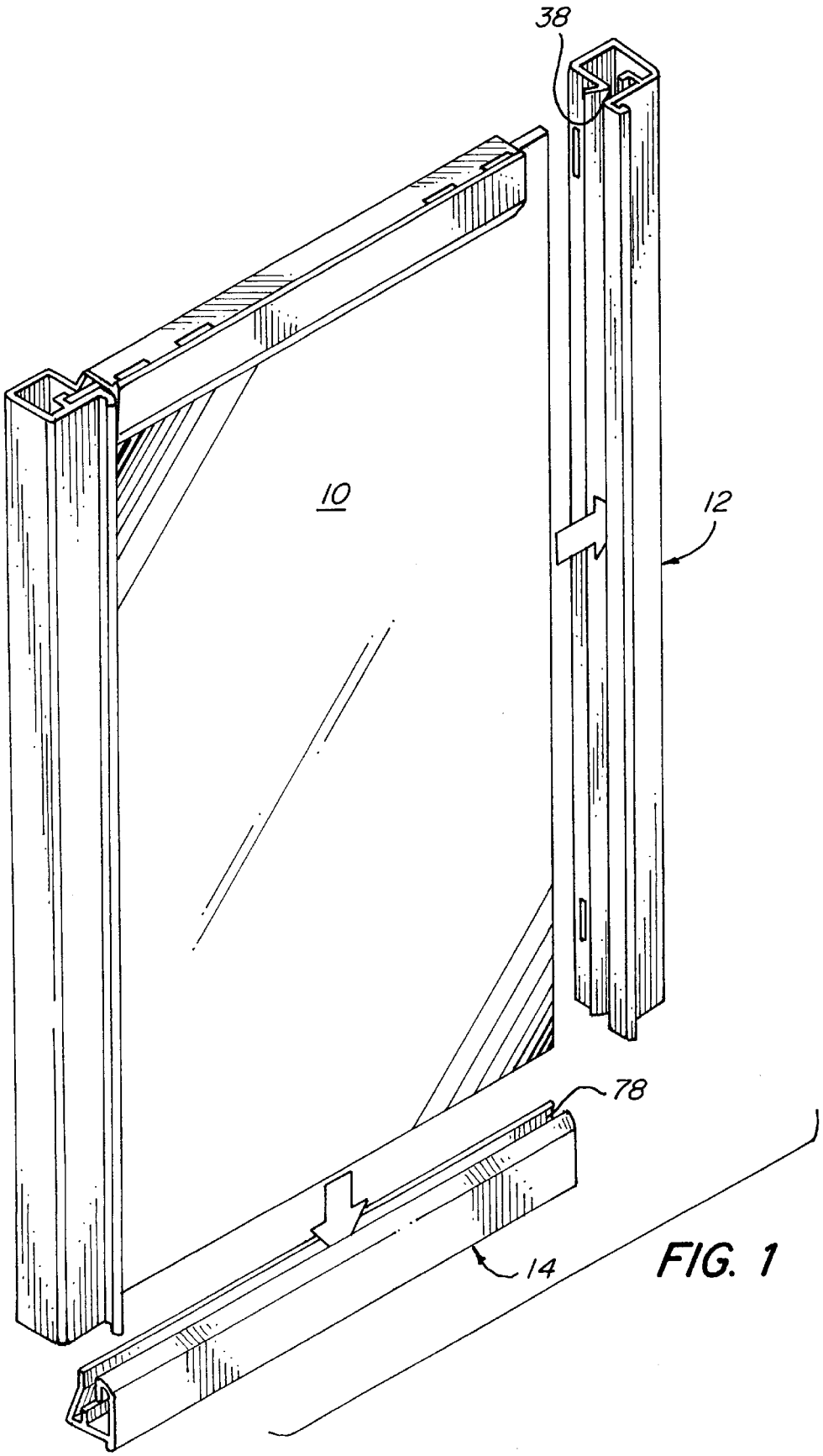
FIG. 1 is a partially exploded perspective view of a mirror door employing the gasketless frame of the present invention with arrows showing the manner of insertion of the panel into the channels of the framing elements.

Turning first to FIG. 1, therein illustrated is a wardrobe door employing a gasketless frame embodying the present invention. In this instance, the door is a mirror door in which a mirror panel generally designated by the numeral 10 is seated in channels 38 in the stiles which are generally designated by the numeral 12 and in channels 78 in the rails which are generally designated by the numeral 14. The stiles 12 and rails 14 together provide the perimeter frame for the door, and are assembled with corner connectors seen in FIG. 8 and 9.

Figure 2:
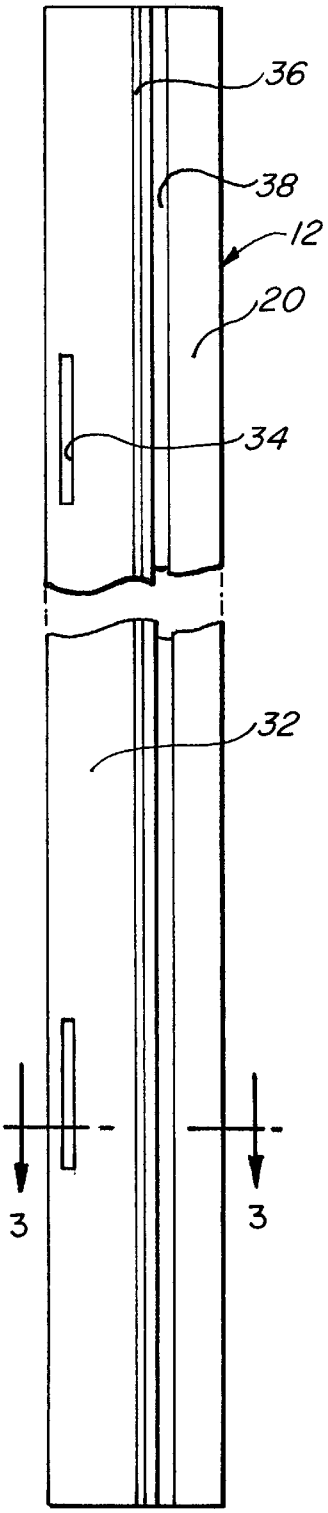
FIG. 2 is a fragmentary side elevational view of the stile of the gasketless frame of FIG. 1.
Figure 4:
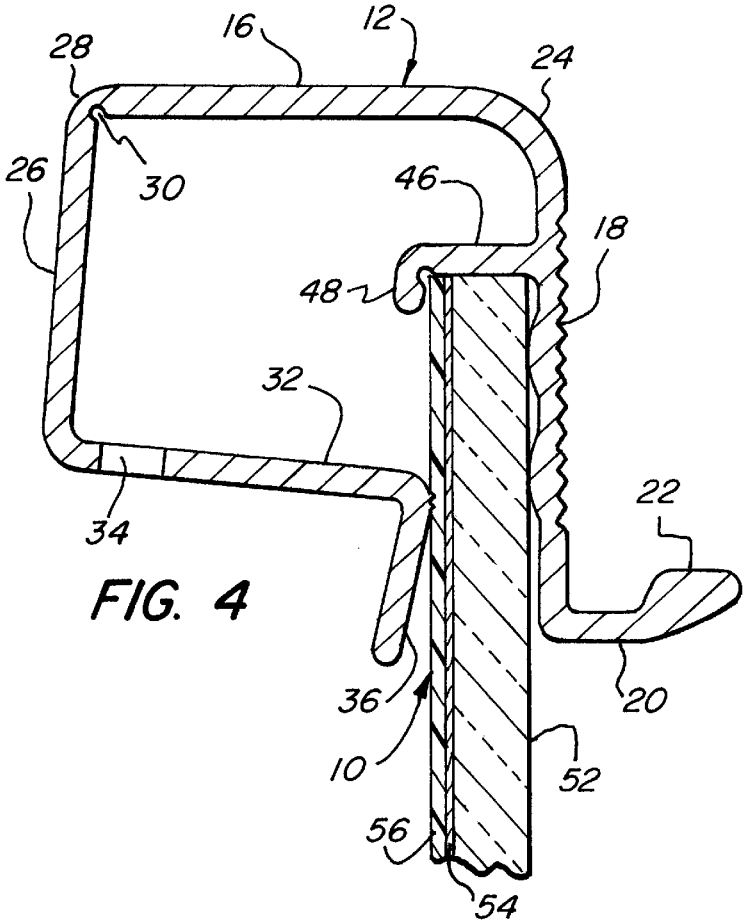
FIG. 4 is a sectional view similar to FIG. 3 but showing the mirror panel inserted into the stile.
Figure 3:
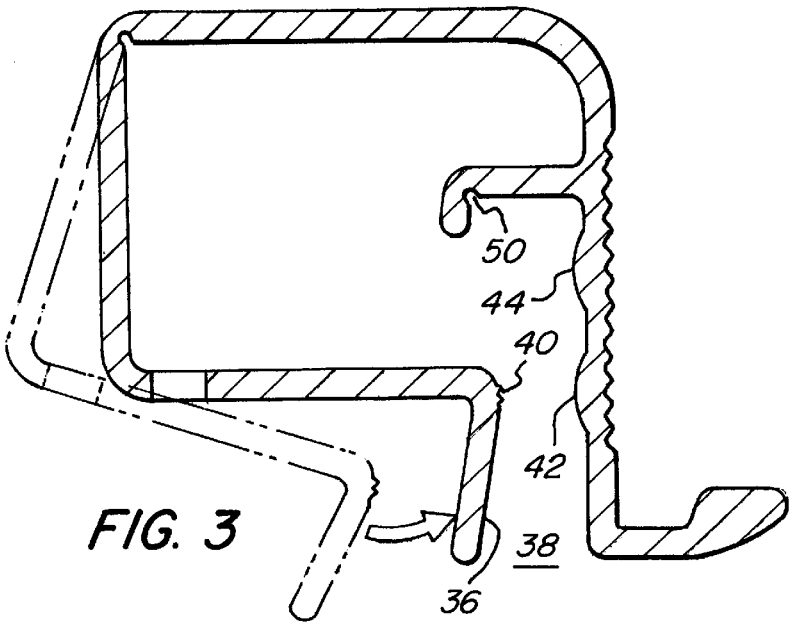
FIG. 3 is a sectional view of the stile along the line 3—3 of FIG. 2 drawn to a greatly enlarged scale with arrows showing the rear wall deflected about its juncture with the outer wall as shown in phantom line, and in its at rest position in solid line.

Turning in detail to the stile 12 as seen in FIGS. 2–4 it has an outer wall 16 and front and rear walls 18, 26 extending generally perpendicularly from the front and rear sides of the outer wall 16. The rear wall 26 is resiliently deflectable about its juncture 28 with the outer wall 16, and this deflectability is enhanced by the groove 30 which significantly reduces the thickness of the metal at the juncture.

The inner wall 32 extends perpendicularly forwardly from the inner end of the rear wall 26, but is spaced from the front wall 18 to provide a channel 38 therebetween. The inner wall 32 includes vertically extending elongated slots 34 extending therethrough adjacent the ends of the stile 12. A flange 36 extends inwardly and rearwardly from the front end of the inner wall 32 to guide the panel 10 gradually into the channel 38 during assembly.

A shelf 46 extends perpendicularly rearwardly from the inner surface of the front wall 18 at a point spaced from the outer wall 16, and it terminates in a perpendicularly inwardly extending leg 48. As seen in FIG. 4, the shelf 46 seats the edge of the panel 10.

A flange 20 extends perpendicularly forwardly from the inner end of the front wall 18 and terminates for aesthetic reasons in an enlarged outwardly projecting lip 22 and to provide a functional handle by which the stile may be gripped by the user's forefingers to slide the door.

The front surface of the flange 36 has small ribs or barbs 40 thereon to bear on and grip the rear polyethylene backing 56 which covers the silver layer 54 on the mirror panel 10. These barbs 40 are opposite and cooperate with convex projection or rib 42 on the inner surface of the front wall 18. In addition, a second similar convex projection 44 is spaced intermediate and apart from the flange 46 and the convex projection 42. These convex projections 42, 44 provide two points of contact between the front face 52 of the mirror 10 and the inner surface of the front wall 18 and facilitate movement of the panel 10 onto the shelf 46.

Figure 5:
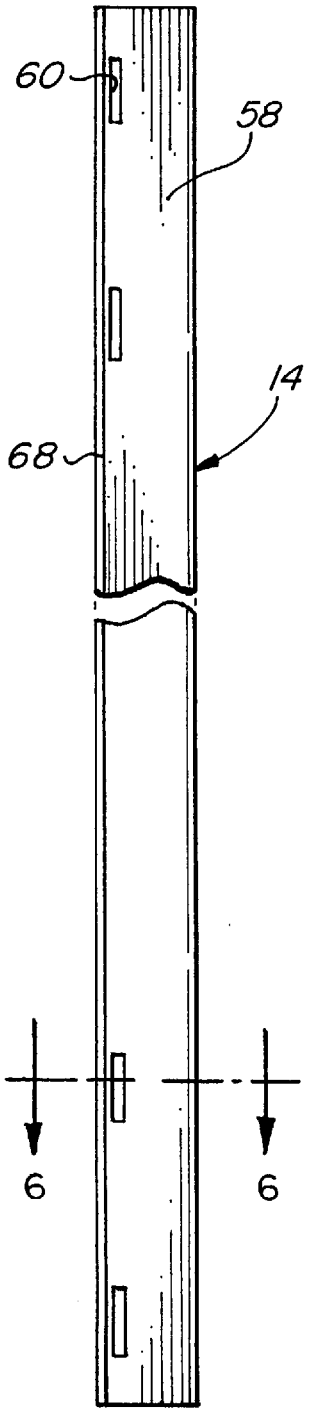
FIG. 5 is a fragmentary side elevational view of the rail of the gasketless frame of FIG. 1.
Figure 7:
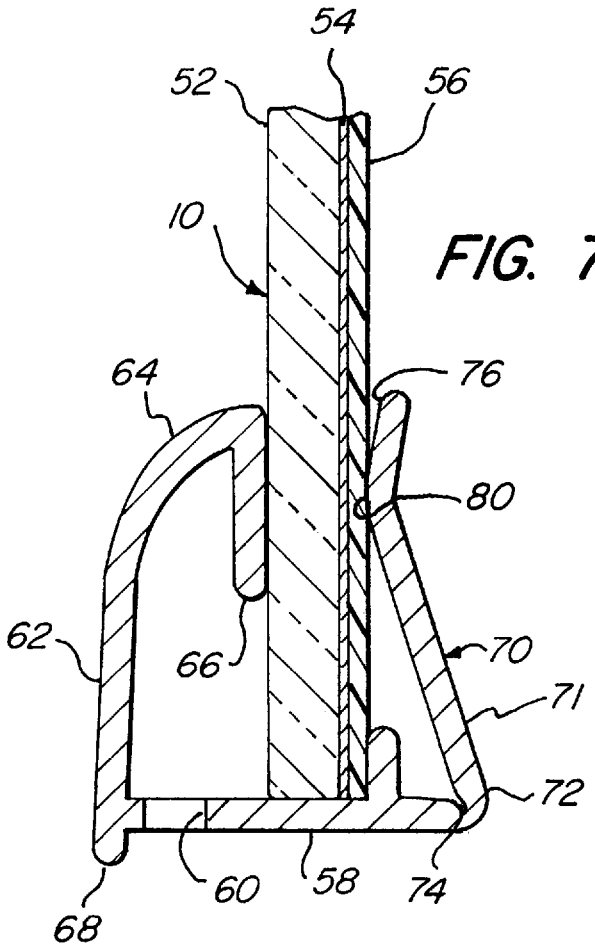
FIG. 7 is a sectional view similar to FIG. 6, but showing the mirror panel inserted into the rail.
Figure 6:
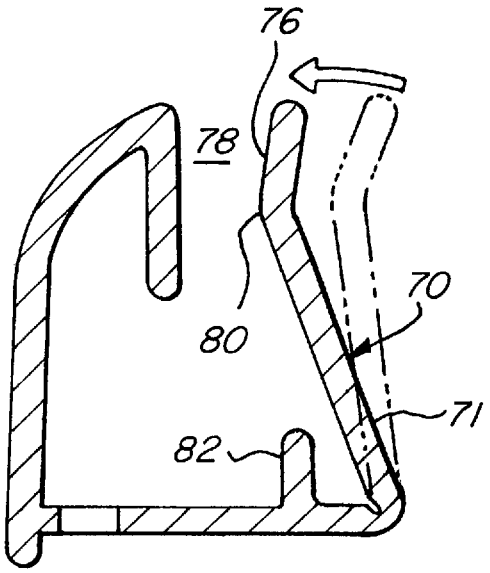
FIG. 6 is a sectional view along the line 6—6 of FIG. 5 drawn to a greatly enlarged scale and showing the rear wall shown in a deflected position, in phantom line and in its at rest position in solid line.

Turning next in detail to the rail 14 which is illustrated in FIGS. 5–7, it has an outer wall 58 with horizontally extending elongated slots 60 extending therethrough adjacent its ends. Front and rear walls 62, 70 extend inwardly from front and rear sides of the outer wall 58 to provide the outer, front and rear faces of the rail 14. The rear wall 70 has a first portion 71 which is angled toward the front wall 62 and is resiliently deflectable about its juncture 72 with the outer wall 58, and this is enhanced by the groove 74 in the inner surface of the juncture 72.

The rear wall 70 has a portion 76 at its free end which is angled oppositely. The front wall 64 has an arcuately inwardly extending upper portion which has at its end a depending flange 66 which extends toward the outer wall 58 to provide one side of channel 78 which is bounded on the other side by the juncture 80 between the portions 71,76 of the rear wall 70. The reverse angle of the portion 76 facilitates guidance of the panel 10 into the channel 78 during assembly.

An upstanding rib 82 extends perpendicularly inwardly from the inner surface of the outer wall 58, and it has one surface aligned with the juncture 80. The rib 82 provides an abutment for the rear surface of the mirror 10 to position the mirror 10. For aesthetic reasons, the front wall 62 extends beyond the outer surface of the outer wall 58 to provide a skirt 68.

Upon assembly, the front surface 52 of the mirror 10 abuts the flange 66 of the front wall 62, and the rear backing 56 of the mirror 10 abuts the juncture 80.

In both the stile 12 and the rail 14, the resilient deflection of their rear walls 26, 70 applies a biasing pressure on the rear surface of the mirror panel 10 to seat it firmly in the channel 38, 78 against the front wall 18, 62.

Figure 8:
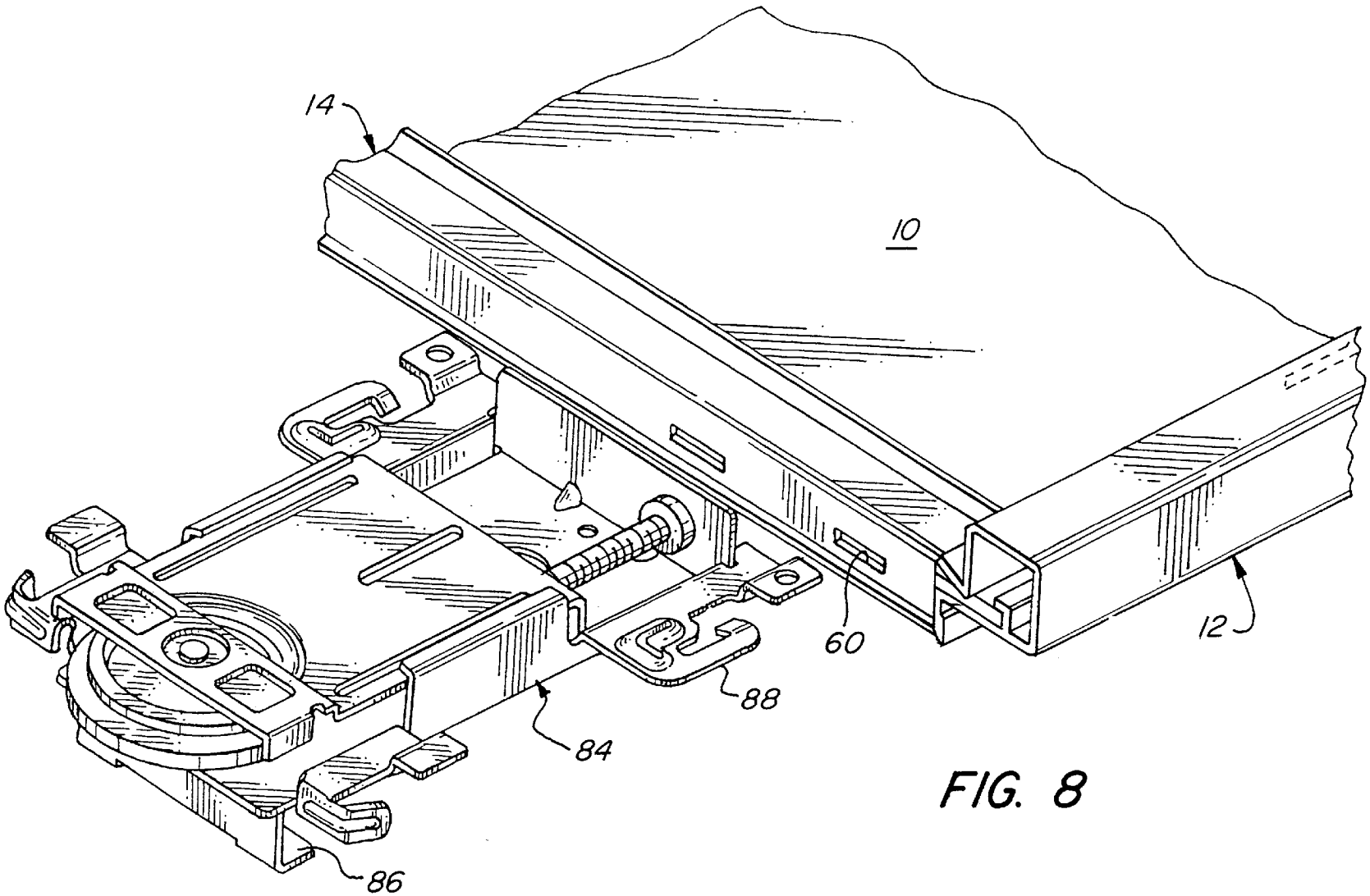
FIG. 8 is a fragmentary perspective view of a bottom corner connector prior to assembly with the stile and rail of the gasketless frame.
Figure 9:
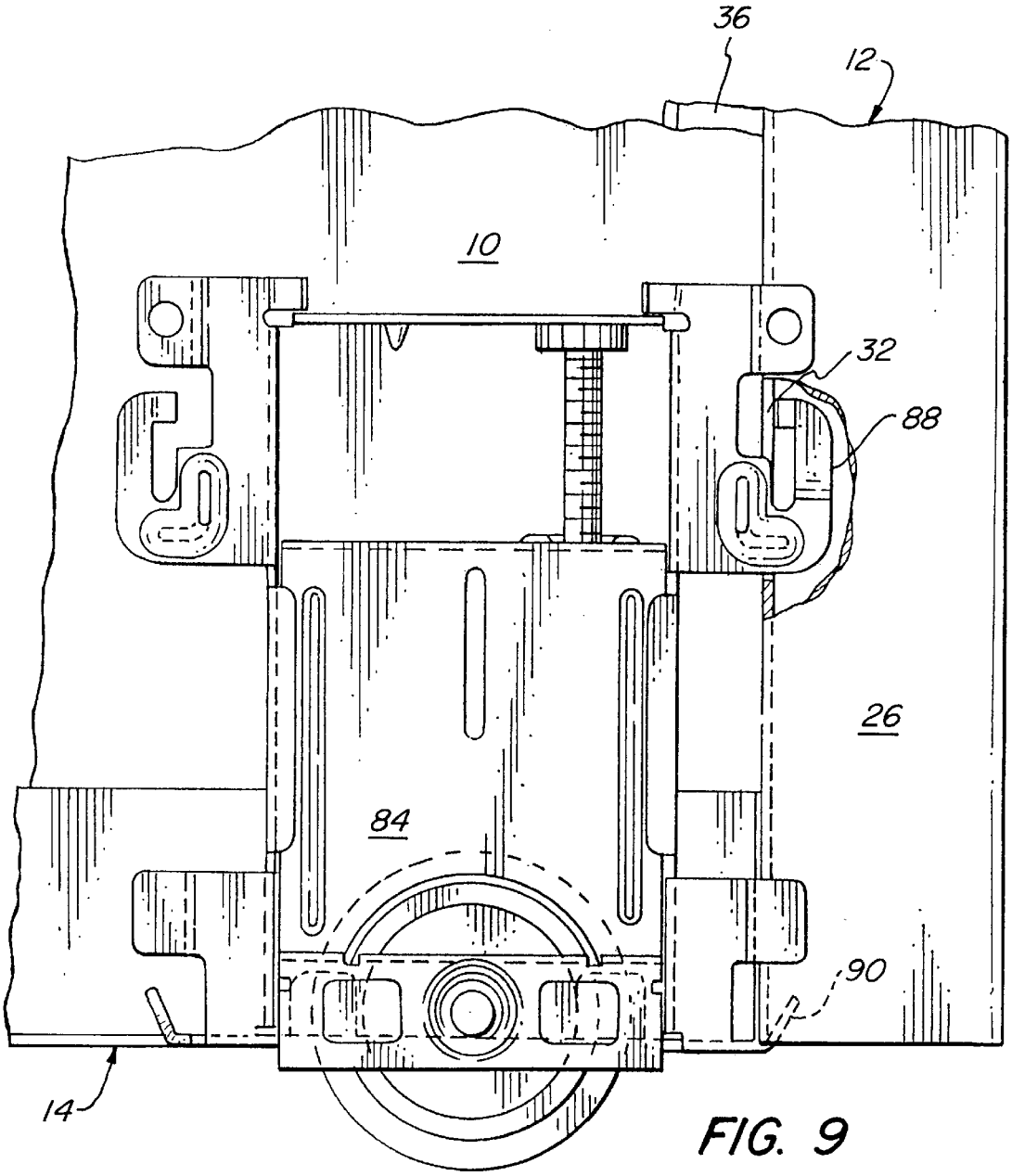
FIG. 9 is a fragmentary rear elevational view of the mirror door after the corner connector of FIG. 8 is assembled on the lower portion of the gasketless frame.

As seen in FIGS. 8–9, the door frame is completed by corner connectors which engage the adjacent ends of the stiles 12 and rails 14. A sliding door roller assembly is generally designated by the numeral 84 and engages the lower ends. The roller assembly 84 includes upwardly projecting tabs 86 which seat within the horizontally extending elongated slots 60 in the bottom rail 14. In addition, the roller assembly 84 includes locking arms 88 which seat and lock within the vertically extending slots 34 in the inner wall 32 of the stile 12. Finally, the bottom portion of the roller assembly 84 includes upwardly and outwardly extending lips 90 which seat the bottom edge of the rear wall 26 of the stile member 12.

The top ends of the stiles 12 and rails 14 are similarly assembled with top corner connectors.

During assembly, the mirror panel 10 is easily seated in the channels 38, 78 of the stiles 12 and rails 14 as indicated by the arrows in FIG. 1. Usually, the panel 10 is supported in a horizontal position on a flat surface, and the stiles 12 and rails 14 are assembled thereabout. During assembly, the guide surfaces 36, 76 of the stiles 12 and rails 14 guide the edges of the panel 10 into the slots 38, 78.

As the panel 10 passes into the slot 38 of the stile 12, the inner wall 32 and rear wall 26 connected thereto deflect at the juncture 28 as illustrated in FIGS. 3 and 4 to permit the panel 10 to be inserted into the channel 38, which is narrower than the thickness of the panel. The inner wall 32 of the stile 12 is biased against the polyethylene backing 56 of the panel and seats the panel 10 against the convex projections 42, 44 on the inner surface of the front wall 18. The frictional fit created by the biased inner wall 32 and the rear wall 26 thereby retains the panel 10 once it is fully inserted into the stile member 12 with its edge abutting the abutment flange 46.

The assembly of the rail member 14 on the panel 10 is similar to that of the stile member 12. As the rail 14 is fitted onto the panel 10, the panel 10 is guided into the channel 78 as illustrated by the downwardly projecting arrow in FIG. 1. This deflects the rear wall 70 rearwardly to allow the panel 10 to pass into the channel 78 which has a width narrower than the thickness of the panel 10. Once fully inserted, the end of the panel 10 abuts the outer wall 58 of the rail 14 and the rear surface of panel 10 abuts the flange abutment 82. The resiliently deflectable rear wall 70 biases the panel 10 against the flange 66 of the front wall 62 to retain the panel 10 securely within the rail 14.

The biasing action of the resiliently deflectable rear walls 26, 70 eliminates the need for flexible vinyl gaskets to retain the panel 10 within the stiles 12 and rails 14. This, in turn, enables much quicker and easier assembly of wardrobe doors and a reduction in material and manufacturing costs.

The gasketless frame members are initially formed as aluminum extrusions which are further formed in a post forming operation. The extrusion may be approximately 10 percent thinner than normal since it is extruded in a non-hollow die, and thereafter post formed to provide a close tolerance gap for the channel. This may be further adjusted by a secondary forming operation since the channel width is quite critical.

As a specific example of gasketless framing elements, aluminum extrusions are made with a wall thickness of about 0.045 inch and subjected to a secondary forming operation to provide a channel width of about 0.095±0.005 inch for a mirror and backing of about 0.120±0.010 inch. to achieve this width, the roll dies pinch the extrusion to a width of about 0.085 inch, and the springback is to the desired width.

Thus, it can be seen from the foregoing detailed description and attached drawings that the gasketless frame of the present invention effectively retains a panel without requiring the use of vinyl gaskets, and it is readily assembled. The frame elements are readily and economically fabricated and may be formed to provide a close tolerance for the channels to receive the edge portions of the panels and provide the resilient deflection.

Having thus described the invention, what is claimed is:

1. An integrally formed gasketless extruded aluminum door framing element for receiving the edge of a panel, said framing element having front, rear, outer and inner faces defining inward, outward, frontward and rearward directions, said framing element comprising:

(a) an outer wall providing said outer face and having front and rear sides;

(b) a rear wall extending inwardly along said rear side of said outer wall and providing said rear face, the junction of said rear wall and said outer wall being configured to enable resilient deflection of said rear wall relative to said outer wall;

(c) a relatively rigid front wall providing said front face and extending inwardly along said front side of said outer wall; and (d) an inner wall extending from the inward end of said rear wall towards said front wall and terminating at a point spaced therefrom to provide an inwardly opening channel therebetween to receive the edge portion of an associated panel, said inner wall having a flange extending inwardly from the front wall edge thereof, the junction between said flange and said inner wall being adapted to bear upon a panel seated in said channel, said rear wall being resiliently deflectable about said junction with said outer wall to vary the spacing between said inner wall with its flange and said front wall.

2. A framing element according to claim 1 wherein said framing element is an aluminum extrusion which is further formed to a channel width providing the desired resilient deflection.

3. A framing element according to claim 1 wherein said front wall has at least one projection on its surface opposite said inner wall.

4. A framing element according to claim 1 wherein said flange has barbs projecting from the frontal surface thereof to grip the surface of a panel seated in said channel.

5. A framing element according to claim 1 wherein said front wall has a flange extending from the inner surface thereof towards said rear wall and spaced intermediate said inner and outer walls to seat the end of the panel.

6. A framing element according to claim 1 wherein the inward end of said front wall includes a flange extending generally perpendicularly thereto in the frontward direction.

7. A framing element according to claim 1 wherein the junction of said rear wall and said outer wall includes a groove extending along the inner surface thereof to facilitate said resilient deflection.

8. An integrally formed gasketless extruded aluminum door framing element for receiving the edge of a panel, said framing element having front, rear, and outer faces defining outward, frontward, inward and rearward directions, said framing element and comprising:

(a) an outer wall providing said outer face and having front and rear sides;

(b) a relatively rigid front wall providing said front face and extending inwardly along said front side of said outer wall, said front wall having an inward end portion extending towards said rear face of said framing element and a depending flange on the end of said inward end portion extending towards said outer face; and, (c) a rear wall providing said rear face and extending inwardly along said rear side of said outer wall, said rear wall having a first portion adjacent said outer wall angled towards said front wall and a second portion spaced from said outer wall angled oppositely to said first portion, the junction of said rear wall and said outer wall being configured to enable resilient deflection of said rear wall relative to said outer wall, said depending flange on said front wall and said second portion of said rear wall being spaced apart and cooperating to provide an inwardly opening channel to receive the edge portion of a panel, the junction of said first and second portions of said rear wall being adapted to bear upon the panel seated in said channel.

9. A framing element according to claim 8 wherein said framing element is an aluminum extrusion which is further formed to a channel width providing the desired resilient deflection.

10. A framing element according to claim 8 wherein said outer wall has an inwardly extending rib on its inner surface, the frontward edge of said rib being generally aligned with the juncture of said portions of said rear wall to seat the edge portion of a panel thereagainst.

11. A framing element according to claim 8 wherein said junction of said rear wall and said outer wall includes a groove extending along the inner surface thereof to facilitate said resilient deflection.

12. A panel door comprising:

(a) a generally rectangular panel;

(b) a pair of horizontally spaced, integrally formed gasketless extruded aluminum door, stile elements for receiving the side edges of said panel, said stile elements having front, rear, outer and inner faces defining inward, outward, frontward and rearward directions, said framing element including (i) an outer wall providing said outer face and having front and rear sides, (ii) a rear wall extending inwardly along said rear side of said outer wall and providing said rear face, the junction of said rear wall and said outer wall being configured to enable resilient deflection of said rear wall relative to said outer wall, (iii) a relatively rigid front wall providing said front face and extending inwardly along said front side of said outer wall, and (iv) an inner wall extending from the inward end of said rear wall towards said front wall and terminating at a point spaced therefrom to provide an inwardly opening channel therebetween receiving the edge portion of said panel, said inner wall having a flange extending inwardly from the frontward edge thereof, the junction between said flange and said inner wall resiliently bearing upon said panel seated in said channel, said rear wall being resiliently deflectable about said junction with said outer wall to vary the spacing between said inner wall and its flange and said front wall;

(c) a pair of vertically spaced, integrally formed gasketless extruded aluminum door rail elements for receiving the edges of said panel, said rail elements having front, rear, and outer faces defining inward, outward, frontward and rearward directions, and framing element including (i) an outer wall providing said outer face and having front and rear sides, (ii) a relatively rigid front wall providing said front face and extending inwardly along said front side of said outer wall, said front wall having an inward end portion extending towards said rear face of said rail element of said inward end portion extending towards said outer face and a depending flange on the end, and (iii) a rear wall providing said rear face and extending inwardly along said rear side of said outer wall, said rear wall having a first portion adjacent said outer wall angled towards said front wall and a second portion spaced from said outer wall angled oppositely to said first portion, the junction of said rear wall and said outer wall being configured to enable resilient deflection of said rear wall relative to said outer wall, said depending flange on said front wall and said second portion of said rear wall being spaced apart and cooperating to provide an inwardly opening channel to receive the edge portion of said panel, the junction of said first and second portions of said rear wall resiliently bearing upon said panel seated in said channel; and (d) corner connectors coupling the ends of said stiles and rails.

13. A panel door according to claim 12 wherein said stile and rail elements are aluminum extrusions which are further formed to a channel width providing the desired resilient deflection.

14. A panel door according to claim 12 wherein said panel is a mirror.

15. A panel door according to claim 12 wherein said front wall of said stiles has at least one projection on its surface opposite said inner wall bearing upon said panel seated in said channel.

16. A panel door according to claim 12 wherein said flange of said stiles has barbs projecting from the frontward surface thereof gripping the surface of said panel seated in said channel.

17. A panel door according to claim 12 wherein said front wall of said stiles has a flange extending from the inner surface thereof towards said rear wall and spaced intermediate said inner and outer walls seating the end of said panel.

18. A panel door according to claim 12 wherein the inward end of said front wall of said stiles includes a flange extending generally perpendicularly thereto in the frontal direction.

19. A panel door according to claim 12 wherein the junction of said rear wall and said outer wall of said stiles includes a groove extending along the inner surface thereof to facilitate said resilient deflection.

20. A panel door according to claim 12 wherein said outer wall of said rails has an inwardly extending rib on its inner surface thereof, the front edge of said rib being generally aligned with the juncture of said portions of said rear wall and seating an edge portion of said panel thereagainst, and wherein the junction of said rear wall and said outer wall of said rails includes a groove extending along the inner surface thereof to facilitate said resilient deflection.

* * * * *